US011871859B1

(12) United States Patent
Morrison

(10) Patent No.: US 11,871,859 B1
(45) Date of Patent: Jan. 16, 2024

(54) HAT DISPLAY

(71) Applicant: Everett Scott Morrison, Las Vegas, NV (US)

(72) Inventor: Everett Scott Morrison, Las Vegas, NV (US)

(73) Assignee: Everett Scott Morrison, Las Vegas, NV (US)

( * ) Notice: Subject to any disclaimer, the term of this patent is extended or adjusted under 35 U.S.C. 154(b) by 0 days.

(21) Appl. No.: 17/969,585

(22) Filed: Oct. 19, 2022

Related U.S. Application Data

(60) Provisional application No. 63/257,922, filed on Oct. 20, 2021.

(51) Int. Cl.
*A47F 7/06* (2006.01)
*A47F 5/12* (2006.01)
*A47F 5/08* (2006.01)

(52) U.S. Cl.
CPC ..... *A47F 7/06* (2013.01); *A47F 5/08* (2013.01); *A47F 5/12* (2013.01)

(58) Field of Classification Search
CPC ..... A47F 7/06; A47F 5/08; A47F 5/12; A47F 7/065; A47F 5/10; A47G 25/10; A47G 25/746; A47B 61/04; A47C 7/64; B60R 7/10
USPC ..... 211/33, 100, 99, 32; 206/8, 9; D6/320; 223/12; 248/691, 291.1
See application file for complete search history.

(56) References Cited

U.S. PATENT DOCUMENTS 624,848 A * 5/1899 McCausland ..... A47G 25/90 211/1
711,253 A * 10/1902 Martin ..... A47F 7/06 211/33
776,284 A * 11/1904 Wright ..... A47F 7/06 206/8
810,421 A * 1/1906 Koehler ..... A47F 7/06 211/33
939,815 A * 11/1909 Dumond ..... A47H 1/13 248/254
954,391 A * 4/1910 Heagany ..... A47F 7/06 211/33
961,418 A * 6/1910 Lloyd ..... A42C 3/00 206/8
1,390,372 A * 9/1921 Miller ..... A47G 25/10 211/32
1,601,054 A * 9/1926 Wilson ..... A47G 25/10 33/8
1,787,727 A * 1/1931 Hildreth ..... A42B 1/002 206/9
1,926,201 A * 9/1933 Kahns ..... A47G 25/0607 211/32
1,977,172 A * 10/1934 Cohen ..... A47F 7/06 211/33

(Continued)

*Primary Examiner* — Jennifer E. Novosad
(74) *Attorney, Agent, or Firm* — Plager Schack LLP; Mark H. Plager; Kara Verryt

(57) ABSTRACT

A display for displaying and positioning headwear may include a mounting plate configured to attach to a surface; a first arm extending from the mounting plate; a second arm attached to a distal end of the first arm; and a pair of fingers, each finger of the pair of fingers attached to a respective end of the second arm, wherein the second arm together with the pair of fingers is configured to support the headwear in a desired position.

9 Claims, 4 Drawing Sheets

(56) References Cited

U.S. PATENT DOCUMENTS 2,068,285 A * 1/1937 Bierman ..... A47G 25/0685 211/104
2,087,757 A * 7/1937 Foss ..... D06F 57/127 211/99
2,107,178 A * 2/1938 Fackler ..... A47F 7/06 211/33
2,442,723 A * 6/1948 Economakis ..... A42B 1/002 2/175.4
2,480,731 A * 8/1949 Haughwout ..... A47F 7/06 211/33
2,662,717 A * 12/1953 Johnson ..... A47J 47/16 211/32
2,939,585 A * 6/1960 Burgin ..... A47G 25/10 224/927
3,208,597 A * 9/1965 Hansen ..... A47G 25/10 211/32
4,535,923 A * 8/1985 Manke ..... B60N 3/103 224/272
4,690,285 A * 9/1987 Stone ..... B43M 99/008 248/442.2
4,739,909 A * 4/1988 Bury ..... A42B 1/002 223/15
5,082,121 A * 1/1992 Grubb ..... A47F 7/06 211/195
5,094,369 A * 3/1992 Thompson ..... A47G 25/10 223/15
5,303,829 A * 4/1994 Kennedy ..... A47F 7/06 211/32
5,538,144 A * 7/1996 Reed ..... A47G 25/10 211/32
5,566,837 A * 10/1996 Lema ..... A47F 7/06 211/32
5,624,041 A * 4/1997 Van Druff, Jr. ..... A47F 7/06 211/33
5,634,575 A * 6/1997 Scharrenberg ..... A42B 1/002 223/24
5,927,515 A * 7/1999 Llaurado Morant .. A42B 3/006 211/32
5,950,845 A * 9/1999 Harris ..... A47G 25/0685 211/100
6,209,835 B1 * 4/2001 Walrath ..... F16M 11/28 248/276.1
7,168,577 B1 * 1/2007 Moseley ..... A47F 7/06 211/32
7,204,375 B2 * 4/2007 Paiste ..... A47F 7/00 211/85.6
7,665,616 B1 * 2/2010 Hobbie ..... A47F 7/06 211/31
8,701,954 B1 * 4/2014 Weinmeister ..... B60R 7/10 224/42.32
D742,729 S * 11/2015 Morrison ..... D8/373
10,117,535 B2 * 11/2018 Wood ..... A47F 7/065
11,457,752 B1 * 10/2022 Cetera ..... A47F 5/0838
2016/0076695 A1 * 3/2016 Henington ..... D06F 57/04 248/205.5

* cited by examiner

HAT DISPLAY

RELATED APPLICATION

This application claims priority to provisional patent application U.S. Ser. No. 63/257,922 filed on Oct. 20, 2021, the entire contents of which is herein incorporated by reference.

BACKGROUND

The embodiments described herein relate generally to displays and, more particularly, to a display for hats, such as ball caps.

Many individuals own hats, such as ball caps, that they would like to display. Conventional display systems for ball caps either damage the caps by causing holes or by using clips, and/or they fail to display the cap at any various desired angle. Other conventional display systems do not provide for easy removal and mounting of the cap, resulting in it being tedious for a user to remove the cap to wear it and then place the cap back onto the display afterwards.

Therefore, what is needed is a display for hats, such as ball caps, wherein the display provides for total control of the angle and positioning of the cap and may be used with any sized cap.

SUMMARY

Some embodiments of the present disclosure include a display for displaying and positioning headwear. The display may include a mounting plate configured to attach to a surface; a first arm extending from the mounting plate; a second arm attached to a distal end of the first arm; and a pair of fingers, each finger of the pair of fingers attached to a respective end of the second arm, wherein the second arm together with the pair of fingers is configured to support the headwear in a desired position.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

Figure 1:
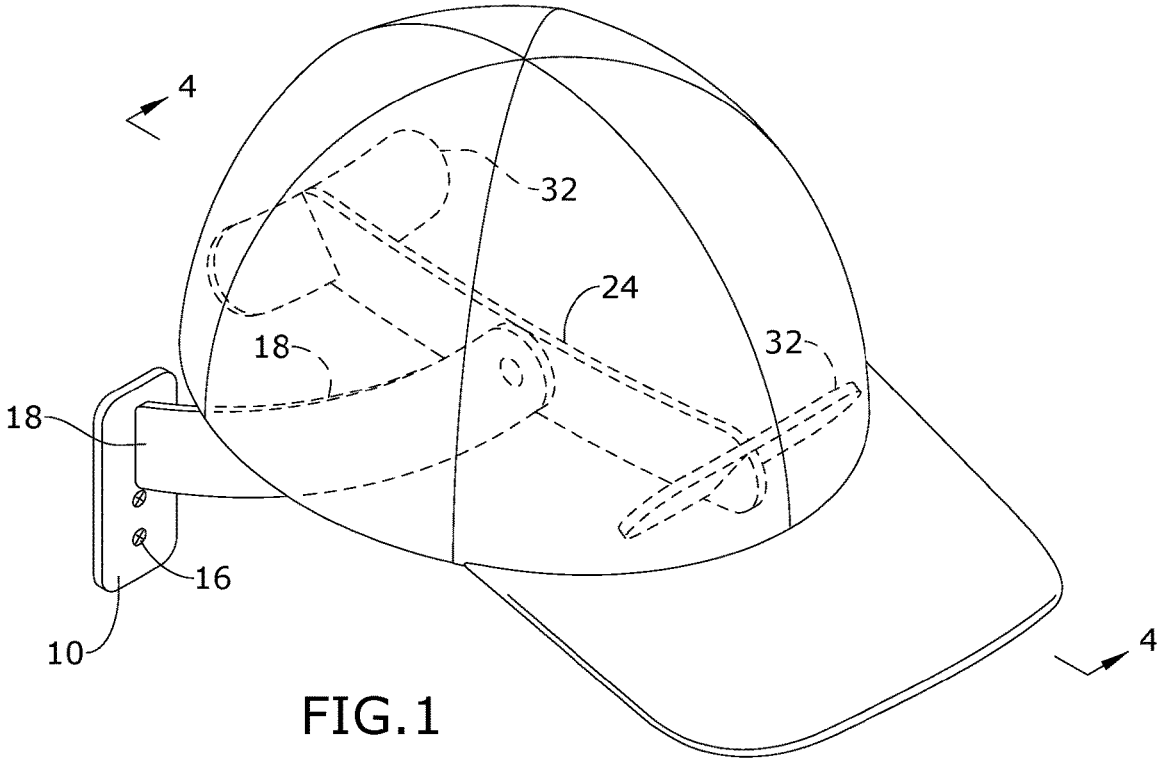
FIG. 1 is a perspective view of one embodiment of the present disclosure, shown in use.
Figure 2:
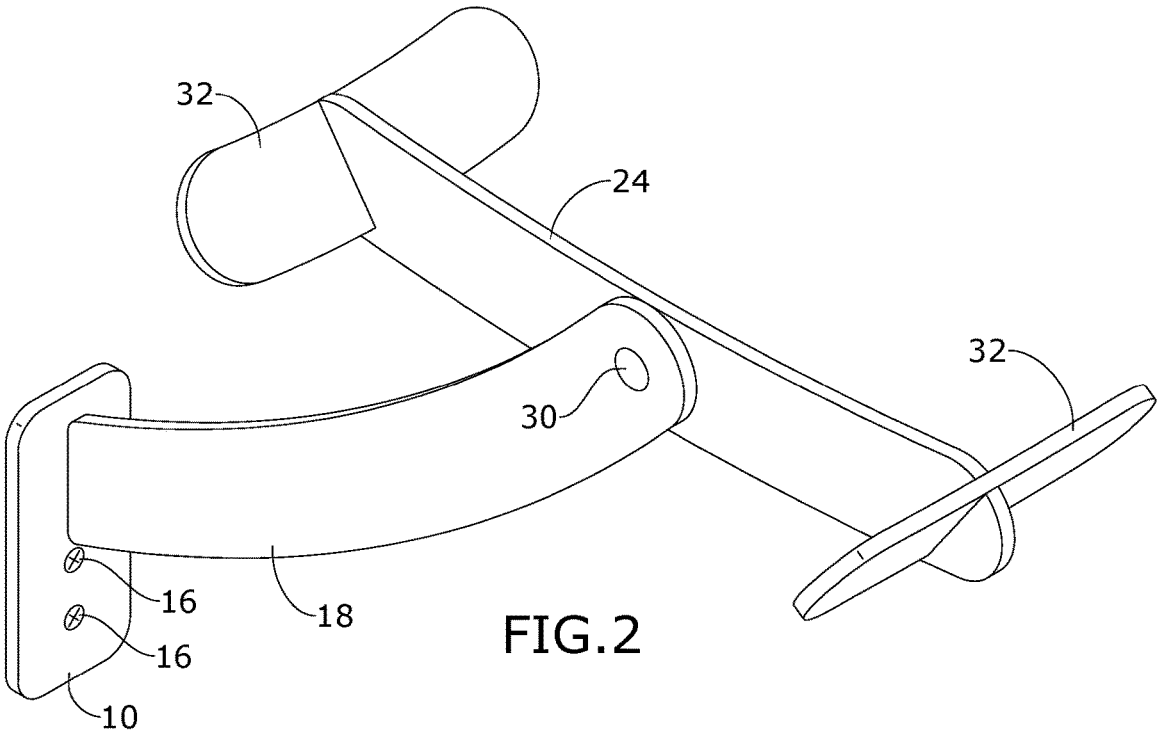
FIG. 2 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a hat display and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements, and the following examples are presented as illustrative examples only.

By way of example, and referring to FIGS. 1-5, some embodiments of the present disclosure include a display for headwear, such as a hat or ball cap, the display comprising a mounting plate 10 configured to attach to a surface, such as a wall 38, a first arm 18 extending from the mounting plate 10, a second arm 24 pivotably attached to a distal end of the first arm 18, and a pair of fingers, each finger 32 of the pair of fingers attached to a respective end of the second arm, such that an elongate length of each finger 32 is substantially perpendicular to an elongate length of the second arm 24.

Figure 3:
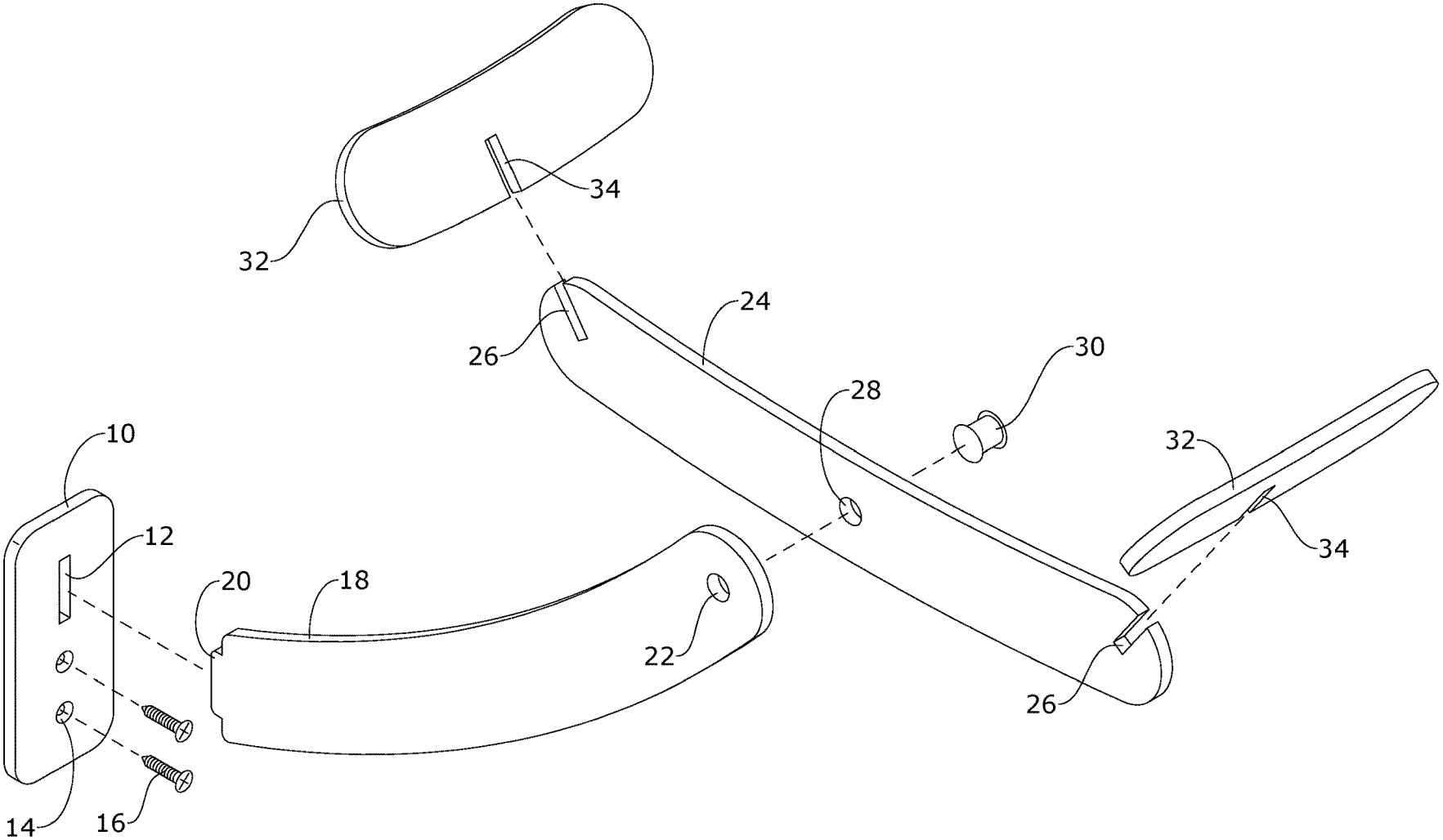
FIG. 3 is an exploded view of one embodiment of the present disclosure.
Figure 4:
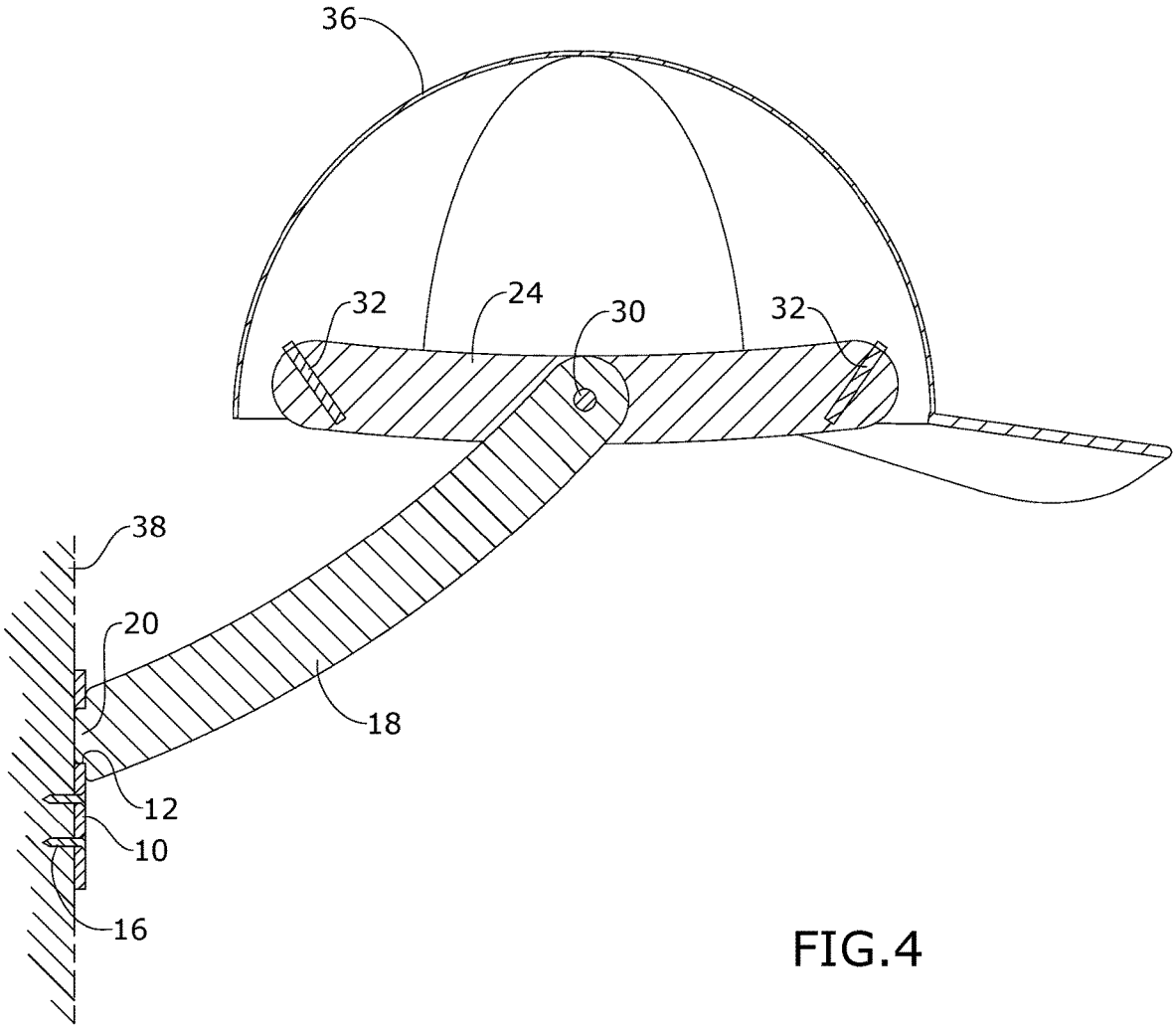
FIG. 4 is a section view of one embodiment of the present disclosure, taken along line 4-4 in FIG. 1.

More specifically, as shown in FIG. 3, the mounting plate 10 may be a substantially planar plate comprising a mounting plate slot 12 and at least one, such as two, fastener orifices 14 extending therethrough. The fastener orifices 14 may each be sized to accommodate insertion of a fastener, such as mounting screw 16, therethrough, wherein the fasteners may be used to attach the mounting plate 10 to a horizontal surface, such as wall 38, as shown in FIG. 4. As shown in FIG. 3, the mounting plate slot 12 may be sized and shaped to snugly accommodate insertion of a first arm tab 20 extending from the first arm 18 (described in more detail below) therein. In a particular embodiment, the mounting plate slot 12 may be substantially rectangular and may be oriented such that the elongate length of the mounting plate slot 12 is parallel to the elongate length of the mounting plate 10.

In embodiments, the first arm 18 may comprise a planar, curved plate comprising a proximal end and a distal end. The proximal end of the first arm 18 may have a first arm tab 20 extending therefrom, wherein a height of the first arm tab 20 may be less than a height of the proximal end of the first arm 18, such that when the first arm tab 20 is inserted into the mounting plate slot 12, the proximal end of the first arm 18 may extend past the mounting plate slot 12. As shown in, for example, FIG. 3, the first arm tab 20 may be sized and shaped to be inserted within the mounting plate slot 12 and, in some embodiments, is substantially rectangular in shape. The distal end of the first arm 18 may have a first arm orifice 22 extending therethrough, wherein the first arm orifice 22 may be sized to accommodate insertion of a connector 30, such as a rivet, therein attaching the first arm 18 to the connector 30. As shown in the Figures, the distal end of the first arm 18 may be rounded.

Figure 5:
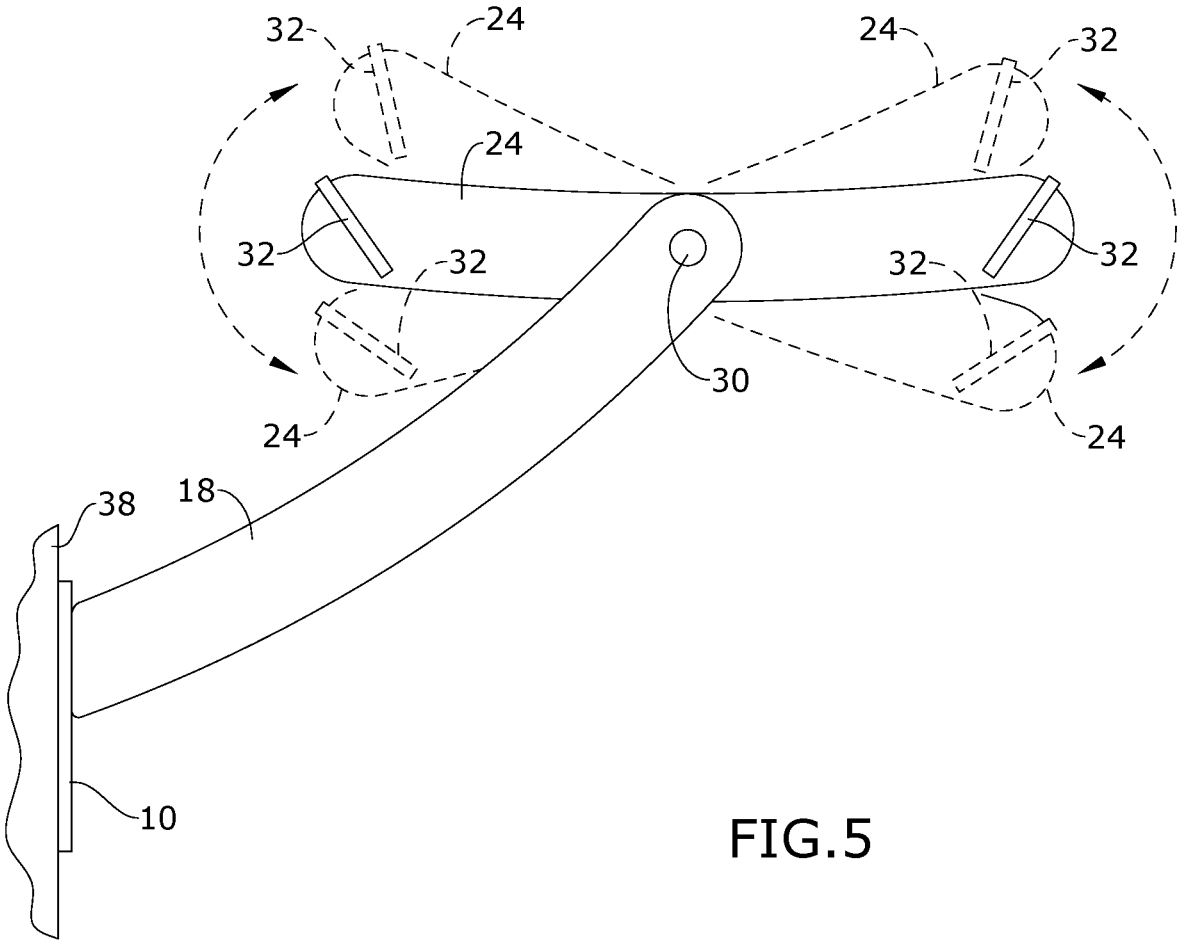
FIG. 5 is a side view of one embodiment of the present disclosure, illustrating adjustability of the angle of display.

In embodiments, the second arm 24 may be substantially planar and oblong shaped plate. A second arm orifice 28 may extend through a central portion of the second arm 28, wherein the second arm orifice may be sized to accommodate insertion of the connector 30 therein. In embodiments, the second arm orifice 28 may be substantially circular such that the second arm 28 is capable of pivoting about the external surface of the connector 30, as shown in FIG. 5. Thus, the second arm 28 may be pivotably attached to the first arm 18 via the connector 30. The second arm 24 may have a first end and a second end, wherein each of the first end and the second end are attached or otherwise engaged with a first finger and a second finger, respectively. For example, and as shown in FIG. 3, each of the first end and the second end may comprise a second arm interlocking slot 26 extending therein. Each second arm interlocking slot 26 may extend at an angle from the end of the second arm 24 in toward the body of the second arm 24.

As shown in the Figures, each of the fingers 32 may be substantially planar and oblong shaped, wherein each of the fingers 32 may be shorter in length than the second arm 24. In embodiments, the fingers 32 may be identical in shape to one another. As shown in the Figures, each finger 32 may comprise a centrally located finger interlocking slot 34 extending from a bottom edge of the finger 32 up to an area proximal to the center of the finger body. The finger interlocking slot 34 may be sized to engage with the second arm interlocking slot 26 such that each of the fingers 32 slide onto the respective end of the second arm 24. However, in other embodiments, the fingers 32 may be attached to the second arm 24 using other known or conventional fastening means. In fact, in some embodiments, the fingers 32 together with the second arm 24 may be made as a singular piece.

The components of the display of the current disclosure may have any suitable or desired dimensions and may vary depending on the headwear being displayed. However, in any case and as shown in the Figures, the second arm 24 may have a length suitable for fitting within the crown of a cap or hat. As such, the second arm 24 may have a length smaller than the largest diameter of the crown. The fingers 32 may also be sized to fit within the crown of the hat or cap, wherein the fingers 32 may have a length that is shorter than that of the second arm 24. The components of the display may also be made of any suitable materials and, in some embodiments, comprise a rigid material.

To use the display of the present disclosure, the mounting plate 10 may be mounted to a surface, such as a wall 38. A cap 36 may then be placed thereon by positioning the distal end of the first arm 18, the second arm 24, and the two fingers 32 within the crown of the cap 36. The cap 36 may then be tilted to the desired positioning, causing the second arm 24 to pivot with respect to the first arm and resulting in the cap 36 being displayed in its desired positioning.

While the display of the present disclosure is described above as being used for displaying hats or caps, it is not limited to such use. In fact, it may be used to display any item that a user desires to display, such as other headwear, jewelry, second garments, and the like.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A display for headwear, the display comprising:
a mounting plate configured to attach to a surface;
a first arm extending from the mounting plate;
a second arm attached to a distal end of the first arm;
a pair of fingers, each finger of the pair of fingers attached to a respective end of the second arm; and
a connector pivotably attaching the second arm to the first arm,
wherein:
the second arm together with the pair of fingers is configured to support the headwear in a desired position;
the first arm comprises a planar, curved plate comprising a proximal end and the distal end;
the distal end comprises a first arm orifice sized to accommodate insertion of the connector therein;
the second arm comprises a second arm orifice extending through a central portion thereof;
the second arm orifice is sized to accommodate insertion of the connector therein; and
the connector is configured to provide for the second arm pivoting with respect to the first arm.

2. The display for headwear of claim 1, wherein an elongate length of each finger of the pair of fingers is substantially perpendicular to an elongate length of the second arm.

3. The display for headwear of claim 1, wherein the second arm is pivotably attached to the distal end of the first arm.

4. The display for headwear of claim 1, wherein the mounting plate comprises a mounting plate slot and at least one fastener orifice extending therethrough.

5. The display of claim 4, wherein a proximal end of the first arm comprises a first arm tab extending therefrom, wherein the first arm tab is sized to be accommodated within the mounting plate slot.

6. The display of claim 1, wherein:
the second arm is a planar and oblong shaped plate with a first end and a second end;
each of the first end and the second end are engaged with a first finger and a second finger of the pair of fingers, respectively;
each of the first end and the second end comprises a respective second arm interlocking slot extending inward therein at an angle; and
each of the first finger and the second finger comprises a centrally located finger interlocking slot extending therein, the centrally located finger interlocking slot of the first finger being configured to engage with the second arm interlocking slot on the first end and the centrally located finger interlocking slot of the second finger being configured to engage with the second arm interlocking slot on the second end.

7. The display for headwear of claim 1, wherein each of the fingers is planar and oblong shaped.

8. The display of claim 1, wherein a length of each finger of the pair of fingers is less than a length of the second arm.

9. A display for headwear, the display comprising:
a mounting plate configured to attach to a surface;
a first arm extending from the mounting plate;
a second arm attached to a distal end of the first arm, the second arm being a planar and oblong shaped plate with a first end and a second end; and
a pair of fingers, each finger of the pair of fingers attached to a respective end of the second arm,
wherein:
the second arm together with the pair of fingers is configured to support the headwear in a desired position;
each of the first end and the second end are engaged with a first finger and a second finger of the pair of fingers, respectively;
each of the first end and the second end comprises a respective second arm interlocking slot extending inward therein at an angle; and each of the first finger and the second finger comprises a respective centrally located finger slot extending therein, the centrally located finger interlocking slot of the first finger being configured to engage with the second arm interlocking slot on the first end and the centrally located finger interlocking slot of the second finger being configured to engage with the second arm interlocking slot on the second end.

* * * * *